US010146157B2

(12) United States Patent
Ariizumi

(10) Patent No.: US 10,146,157 B2
(45) Date of Patent: Dec. 4, 2018

(54) DEVELOPMENT APPARATUS HAVING A MULTIPLE SCREW PORTION CONVEYANCE SCREW

(71) Applicant: CANON KABUSHIKI KAISHA, Tokyo (JP)

(72) Inventor: Osamu Ariizumi, Matsudo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/468,342

(22) Filed: Mar. 24, 2017

(65) Prior Publication Data

US 2017/0308005 A1 Oct. 26, 2017

(30) Foreign Application Priority Data

Apr. 22, 2016 (JP) ..... 2016-086444

(51) Int. Cl.
*G03G 15/08* (2006.01)

(52) U.S. Cl.
CPC ..... *G03G 15/0891* (2013.01); *G03G 15/0822* (2013.01); *G03G 15/0889* (2013.01)

(58) Field of Classification Search
CPC ..... G03G 15/0822; G03G 15/0889; G03G 15/0891; G03G 15/0893
See application file for complete search history.

(56) References Cited

U.S. PATENT DOCUMENTS 8,326,180 B2 12/2012 Fujiwara et al.
2005/0031381 A1* 2/2005 Arimoto ..... G03G 15/0877 399/258

FOREIGN PATENT DOCUMENTS

JP 2009-192554 A 8/2009
JP 2010-197539 A 9/2010
JP 2011-248126 A 12/2011
JP 2012-083566 A 4/2012
JP 2016-024353 A 2/2016

OTHER PUBLICATIONS

Osamu Ariizumi et al., U.S. Appl. No. 15/460,317, filed Mar. 16, 2017.
Osamu Ariizumi, U.S. Appl. No. 15/440,119, filed Feb. 23, 2017.

* cited by examiner

*Primary Examiner* — Hoang Ngo
(74) *Attorney, Agent, or Firm* — Fitzpatrick, Cella, Harper & Scinto

(57) ABSTRACT

A developing apparatus includes a rotatable developer bearing member, a first conveyance screw in a first chamber to convey the developer, and a second conveyance screw in a second chamber to convey the developer. The second conveyance screw includes a first screw portion facing a communication portion between the first and second chambers, a second screw portion downstream of the first screw portion, and a third screw portion downstream of the first screw portion and upstream of the second screw portion and facing the second communication portion. The first screw portion includes a first blade portion formed spirally around a rotation shaft of the second conveyance screw, the second screw portion has a second blade portion formed spirally around the rotation shaft of the second conveyance screw, and the third screw portion comprises no blade portion formed spirally around the rotation shaft of the second conveyance screw.

5 Claims, 7 Drawing Sheets

DEVELOPMENT APPARATUS HAVING A MULTIPLE SCREW PORTION CONVEYANCE SCREW

BACKGROUND OF THE INVENTION

Field of the Invention

The present disclosure relates to a developing apparatus suitable for an image forming apparatus using photo-electric technology such as a printer, a copier, a facsimile machine and a multi-function printer.

Description of the Related Art

An image forming apparatus such as a printer, a copier, a facsimile machine and a multi-function printer includes a developing apparatus configured to develop and to visualize an electrostatic latent image formed on a photosensitive drum by a developing agent. A two-component developing agent (referred to simply as 'developer' hereinafter) made of non-magnetic toner and magnetic carrier is used in the developing apparatus. As the developing apparatus, there is known a so-called function separated type configuration which includes a developing chamber configured to supply the developer to a developing sleeve and a collecting chamber configured to collect the developer stripped from the developing sleeve and which circulates the developer between the developing and collecting chambers as disclosed in Japanese Patent Application Laid-Open Nos. 2010-197539 and 2009-192554. The developing and collecting chambers are configured to communicate with each other through communication ports and include developing and agitating screws configured to convey the developer within the respective chambers.

In the case of the function separated type developing apparatus, a developer surface level in the collecting chamber increases gradually from upstream to downstream in a developer conveyance direction of the agitating screw if the developer reaches a condition in which the developer is stabilized, i.e., a so-called steady condition. Then, the developer is delivered from the collecting chamber to the developing chamber through the communication port downstream in the developer conveyance direction of the agitating screw. It is noted that in the following description, 'upstream' or 'downstream' refers to upstream or downstream in the developer conveyance direction of the agitating screw unless specified otherwise.

If fluidity of the developer drops in the developing apparatus described above in particular, the delivery of the developer from the collecting chamber to the developing chamber is restrained. As a result, the developer surface lever is apt to be high within the collecting chamber. If the developer surface level becomes too high within the collecting chamber, the developer is apt to be in contact with the surface of the developing sleeve and to be entrained by the developing sleeve. The developer surface level can be lowered by reducing a number of threads of the agitating screw to increase a conveyance force of the agitating screw in an axial direction of the agitating screw in a part of the developing sleeve facing an image forming area in particular. However, due to the increase of the conveyance force, it is desirable to improve delivery efficiency to restrain the developer from continuing to accumulate at a deliver portion. That is, a configuration that can increase the developer surface level at the deliver portion is desired to be able to actively deliver the developer at a part where a level of the downstream communication port is high.

SUMMARY OF THE INVENTION

The present disclosure provides a developing apparatus configured to restrain an accumulation of developer at a deliver portion while lowering a developer surface level at a developing area within a collecting chamber collecting the developer.

According to a first aspect of the present disclosure, a developing apparatus includes a developer bearing member configured to bear developer and to be rotatable, a developing chamber configured to supply the developer to the developer bearing member, a collecting chamber configured to collect the developer conveyed from the developer bearing member and to form a circulation path of the developer with the developing chamber, a wall dividing the developing chamber from the collecting chamber and through which a first communication port delivering the developer from the collecting chamber to the developing chamber and a second communication port delivering the developer from the developing chamber to the collecting chamber are defined, the first communication port being disposed out of a developing area where the developer bearing member bears the developer in a rotation axial direction of the developer bearing member, a first conveyance screw disposed within the developing chamber and conveying the developer in a first direction, and a second conveyance screw disposed within the collecting chamber, including a first screw portion having a first number of threads, configured to convey the developer in a second direction opposite to the first direction and provided in an area facing the developing area and a second screw portion having a number of threads larger than the first number of threads, configured to convey the developer in a second direction opposite to the first direction, disposed in an area out of the developing area in the rotation axial direction and provided in an area facing the first communication port.

Further features of the present invention will become apparent from the following description of exemplary embodiments with reference to the attached drawings.

DESCRIPTION OF THE EMBODIMENTS

Figure 1:
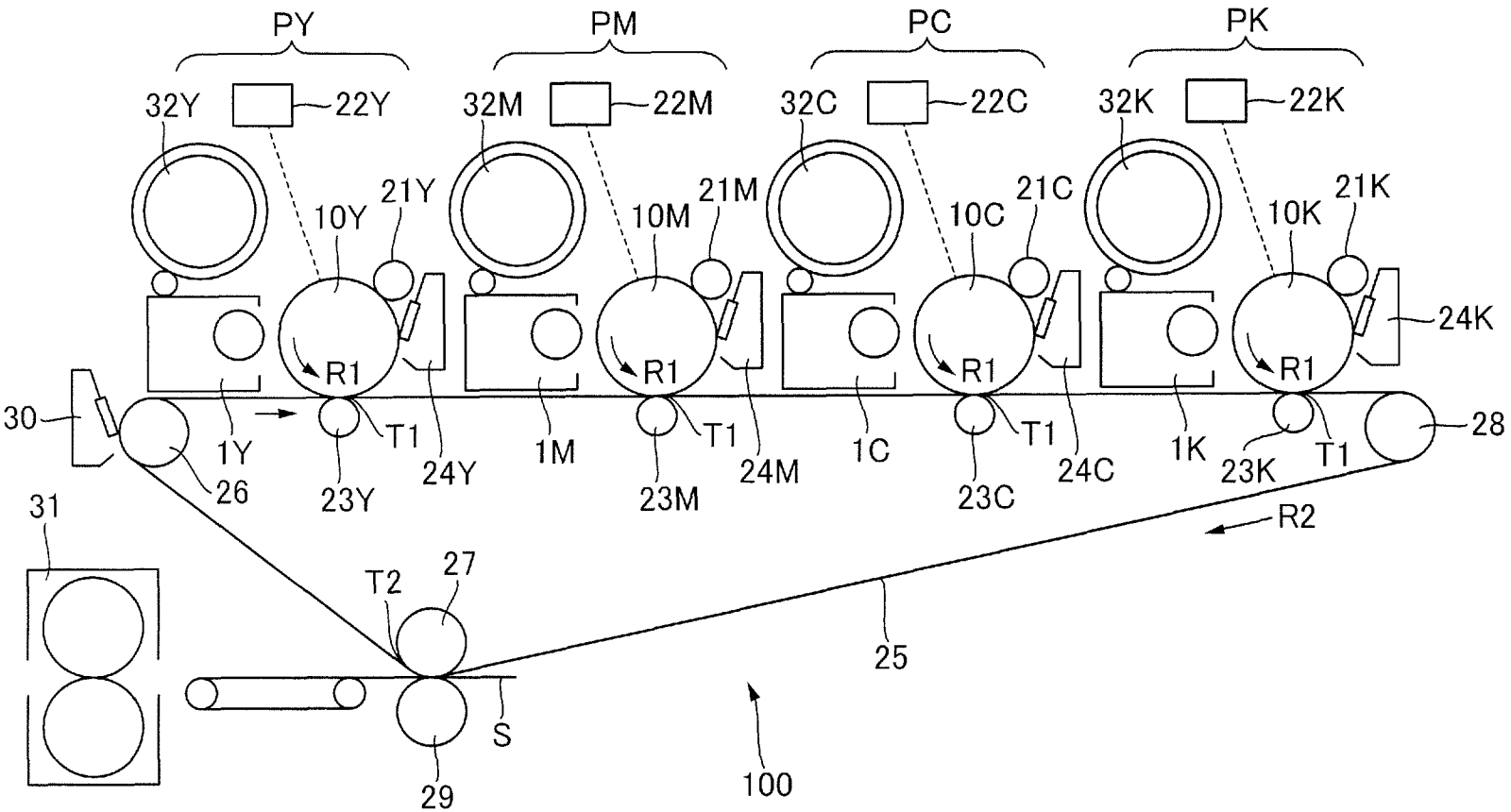
FIG. 1 is a schematic diagram illustrating a configuration of an image forming apparatus to which a developing apparatus of a present embodiment is applied.

A configuration of an image forming apparatus to which a developing apparatus of a present embodiment is applied will be described first with reference to FIG. 1. The image forming apparatus 100 illustrated in FIG. 1 is an intermediate transfer full-color printer of a tandem type in which image forming portions PY, PM, PC, and PK are arrayed along an intermediate transfer belt 25.

Image Forming Apparatus

In the image forming portion PY, a yellow toner image is formed on a photosensitive drum 10Y and is then transferred onto the intermediate transfer belt 25. In the image forming portion PM, a magenta toner image is formed on a photosensitive drum 10M and is then transferred onto the intermediate transfer belt 25. In the image forming portions PC and PK, cyan and black toner images are formed on photosensitive drums 10C and 10K, respectively, and are then transferred onto the intermediate transfer belt 25. The four color toner images transferred onto the intermediate transfer belt 25 are conveyed to a secondary transfer portion (secondary transfer nip portion) T2 and are collectively secondarily transferred onto a recording material S, i.e., a sheet material such as a sheet of paper and an OHP sheet. The recording material S has been taken one by one out of a sheet feed cassette not illustrated and has been conveyed to the secondary transfer portion T2.

The image forming portions PY, PM, PC and PK are configured approximately in a same manner with each other except that the colors of the toners used in the developing apparatuses 1Y, 1M, 1C and 1K are different as yellow, magenta, cyan and black. The configuration and operation of the respective image forming portions PY through PK will be described below while omitting Y, M, C, and K which are subscripts of reference numerals distinguishing the image forming portions PY, PM, PC and PK.

The image forming portion P includes an electrifying roller 21, an exposure unit 22, a developing apparatus 1, a transfer roller 23, and a drum cleaning unit 24 around the photosensitive drum 10 serving as an image bearing member. The photosensitive drum 10 is what a photosensitive layer is formed on an outer circumferential surface of an aluminum-made cylinder and rotates in a direction of an arrow R1 in FIG. 1 with a predetermined processing speed.

The electrifying roller 21 to which electrification potential is applied electrifies the photosensitive drum 10 with a homogeneous negative dark part potential by coming into contact with the photosensitive drum 10. The exposure unit 22 generates a laser beam, which is ON-OFF modulated according to a scan line image data in which a color separation image of each color is developed, from a light emitting element and scans the beam by a rotational mirror to draw an electrostatic image of the image on a surface of the electrified photosensitive drum 10. The developing apparatus 1 supplies toner to the photosensitive drum 10 to develop the electrostatic image as a toner image. The developing apparatus 1 will be detailed later (see FIGS. 2 through 4).

The transfer roller 23 is disposed so as to face the photosensitive drum 10 with the intermediate transfer belt 25 between them and forms a primary transfer portion (primary transfer nip portion) T1 of the toner image between the photosensitive drum 10 and the intermediate transfer belt 25. The toner image is primarily transferred from the photosensitive drum 10 onto the intermediate transfer belt 25 at the primary transfer portion T1 by a primary transfer voltage applied to the transfer roller 23 from a high voltage source not illustrated for example. That is, in response to the application of the primary transfer voltage whose electrification polarity is inverse to that of the toner to the transfer roller 23, the toner image on the photosensitive drum 10 is electrostatically attracted and transferred onto the intermediate transfer belt 25. The drum cleaning unit 24 rubs the photosensitive drum 10 with a cleaning blade to remove primary transfer residual toner slightly left on the photosensitive drum 10 after the primary transfer.

The intermediate transfer belt 25 is supported by being suspended around rollers such as a tension roller 26, a secondary transfer inner roller 27 and a driving roller 28 and is rotated in a direction of an arrow R2 in FIG. 1 by being driven by the driving roller 28. The secondary transfer portion T2 is a nip portion defined by the secondary transfer inner roller 27 brought into contact with the intermediate transfer belt 25 supported by a secondary transfer outer roller 29 and configured to transfer the toner image onto the recording material S. In the secondary transfer portion T2, the toner image is secondarily transferred from the intermediate transfer belt 25 onto the recording material S, which is nipped and conveyed by the secondary transfer portion T2, by a predetermined secondary transfer voltage applied to the secondary transfer inner roller 27. Secondary transfer residual toner adhering and left on the intermediate transfer belt 25 after the secondary transfer is removed by a belt cleaning unit 30 which rubs the intermediate transfer belt 25. That is, the belt cleaning unit 30 removes the secondary transfer residual toner by rubbing the intermediate transfer belt 25 with a cleaning blade.

The recording material S onto which the four color toner images have been transferred at the secondary transfer portion T2 is conveyed to a fixing unit 31. The fixing unit 31 melts and fixes the toner image onto the recording material S by pressure applied by a roller or a belt not illustrated and facing with each other and by heat applied in general from a heat source such as a heater not illustrated. Then, the recording material S onto which the toner image has been fixed by the fixing unit 31 is discharged out of the image forming apparatus.

A toner replenishing unit 32 is configured to be able to replenish toner, i.e., more specifically replenishing developer, of an amount equivalent to an amount of toner consumed by the developing apparatus 1 in the image forming process to the developing apparatus 1.

Developing Apparatus

Figure 2:
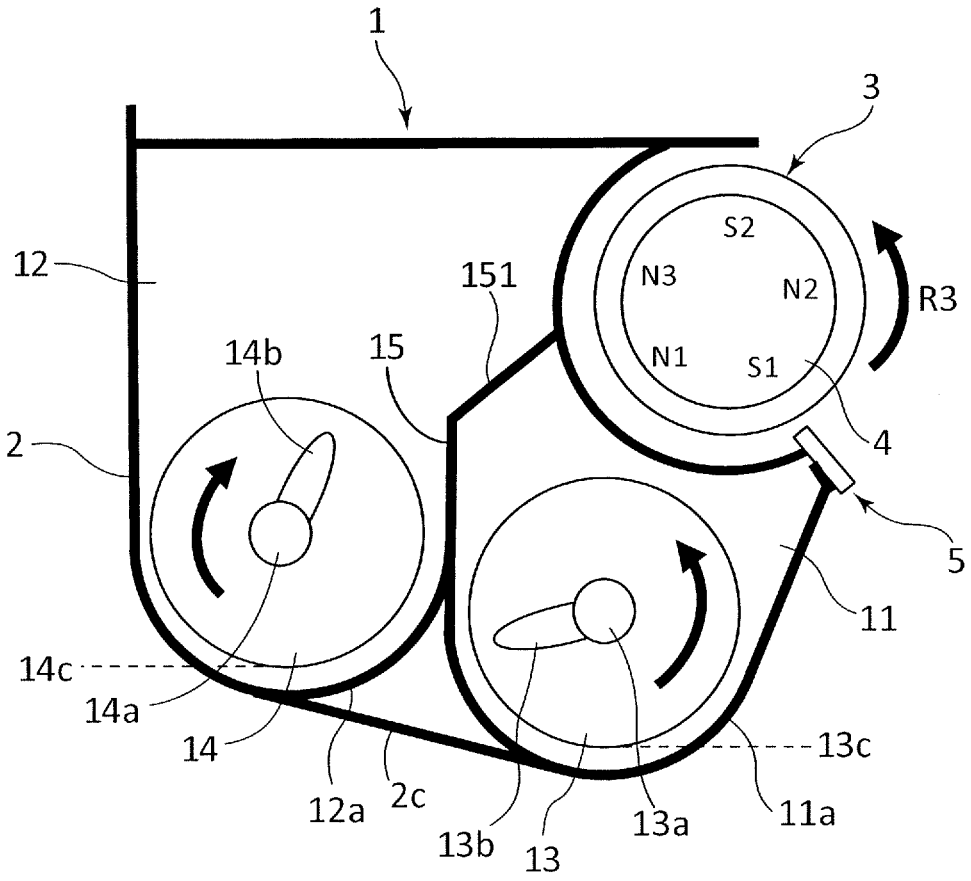
FIG. 2 is a section view illustrating the developing apparatus of the present embodiment.

The developing apparatus 1 of the present embodiment will be described below with reference to FIGS. 2 through 4. As illustrated in FIG. 2, the developing apparatus 1 includes a developing container 2 defining a housing, a developing sleeve 3 serving as a developer bearing member, a regulating blade 5, a developing screw 13 serving as a first screw, an agitating screw 14 serving as a second screw, and others.

A two-component developer containing non-magnetic toner and magnetic carrier is stored in the developing container 2. That is, a two-component developing system is used as a developing system in the present embodiment, and the developer in which the non-magnetic toner of minus charging polarity is blended with the magnetic carrier of plus charging polarity is used. The non-magnetic toner is what a colorant, a wax component and others are included in resin such as polyester and styrene acryl is pulverized by crushing or polymerization. The magnetic carrier is what a resin coating is applied to a surface layer of a core of a resin particle in which ferrite particle and magnetic powder are kneaded. Toner density within the developer in an initial condition, i.e., a rate (ratio) of weight of toner occupying in a total weight of the developer (referred to also as 'TD ratio'), is 8% for example in the present embodiment.

A part of the developing container 2 facing the photosensitive drum 10 (see FIG. 1) is opened, and the developing sleeve 3 serving as the developer bearing member is disposed rotatably such that a part of the developing sleeve 3 is exposed out of the opening part of the developing container 2. The developing sleeve 3 is formed into a cylindrical shape by a non-magnetic material such as an aluminum alloy and is rotationally driven in a direction of an arrow R3 in FIG. 2. Disposed non-rotationally within the developing sleeve 3 is a magnet roller 4 composed of a plurality of magnetic poles.

The developing sleeve 3 rotates in the direction of the arrow R3 in FIG. 2 and bears and conveys the developer attracted at a position of a draw-up magnetic pole N1 of the magnetic roller 4 in a direction of the regulating blade 5. An amount of the developer napped by a regulating magnetic pole S1 is regulated by receiving a shearing force from the regulating blade 5 when the developer passes through a gap between the developing sleeve 3 and the regulating blade 5 such that a developer layer of a predetermined thickness is formed on the developing sleeve 3. The developer layer thus formed is borne and conveyed to a developing area facing the photosensitive drum 10 and develops the electrostatic latent image formed on the surface of the photosensitive drum 10 in a condition in which magnetic naps are formed by a developing magnetic pole N2. The developer left after the development is stripped from the developing sleeve 3 at a non-magnetic zone formed between a stripping magnetic pole N3 and the draw-up magnetic pole N1 which are like-poles adjacent with each other.

Developing Container

The developing container 2 includes a developing chamber 11 serving as a first chamber and a collecting chamber 12 serving as a second chamber and is provided with a partition wall 15 serving as a wall dividing the developing chamber 11 from the collecting chamber 12. The partition wall 15 divides the developing chamber 11 from the collecting chamber 12 such that the partition wall 15 projects out of a bottom surface 2*c* within the developing container 2. The partition wall 15 also extends in a developer conveyance direction of the developing sleeve 3, and the developing and collecting chambers 11 and 12 are defined along the developer conveyance direction of the developing sleeve 3. Then, according to the present embodiment, the developing and collecting chambers 11 and 12 are disposed with a difference of level such that a bottom surface 12*a* of the collecting chamber 12 is located above a bottom surface 11*a* of the developing chamber 11 when viewed from a horizontal direction. Provided above the partition wall 15 is a guide member 151 extending so as to approach the developing sleeve 3 to guide the developer stripped from the developing sleeve 3 to the collecting chamber 12. Preferably, the guide member 151 is provided across a range at least including a coating area where the developing sleeve 3 can bear the developer.

Figure 3:
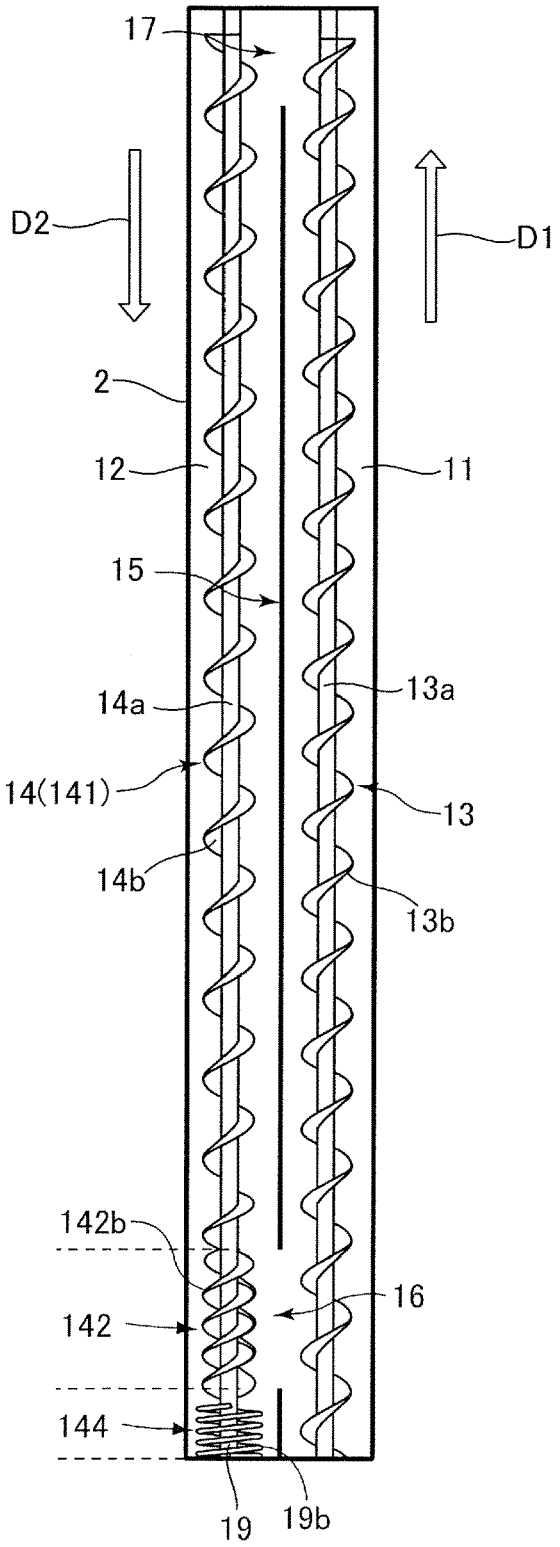
FIG. 3 is an upper section view illustrating the developing apparatus in a view from a horizontal section including an axial direction.

As illustrated in FIG. 3, the partition wall 15 includes first and second communication ports 16 and 17 communicating the developing chamber 11 with the collecting chamber 12 respectively at longitudinal both ends of the partition wall 15. The first communication port 16 is a developer delivering portion that allows the developer to be delivered from the collecting chamber 12 to the developing chamber 11, and the second communication port 17 is what allows the developer to be delivered from the developing chamber 11 to the collecting chamber 12.

As illustrated in FIG. 3, the developing chamber 11 is provided with the developing screw 13 serving as a first conveyance screw configured to convey the developer in a predetermined first direction D1 within the developing chamber 11. The collecting chamber 12 is provided with the agitating screw 14 having a first conveyance portion 141 conveying the developer in a second direction D2 opposite to that of the developing screw 13 within the collecting chamber 12. The developing and agitating screws 13 and 14 are constructed by forming blades 13*b* and 14*b* spirally around rotary shafts 13*a* and 14*a*, respectively. Both ends of the rotary shafts 13*a* and 14*a* are rotatably supported by the developing container 2, respectively. The developing and agitating screws 13 and 14 are disposed such that at least parts thereof overlap with each other when viewed from the horizontal direction. According to the present embodiment, the developing and agitating screws 13 and 14 are disposed such that a lower end 14*c* of the agitating screw 14 is located above a lower end 13*c* of the developing screw 13 when viewed from the horizontal direction as illustrated in FIG. 2. The developing and agitating screws 13 and 14 are formed such that diameters of the rotary shafts 13*a* and 14*a* are 6 mm, outer diameters of the screws including the blades 13*b* and 14*b* are 18 mm, and a screw pitch is 40 mm for example.

The developing sleeve 3, the developing screw 13 and the agitating screw 14 are configured to be linked and driven respectively by a gear train not illustrated and are also rotated respectively through an intermediary of a gear train linked to a driving motor also not illustrated. In the case of the present embodiment, the agitating screw 14 rotates from upward to downward on the side of the partition wall 15 (see FIG. 2). As the developing and agitating screws 13 and 14 rotate, the developer is circulated and conveyed as indicated by arrows D1 and D2 in FIG. 3. At this time, the developer is delivered from the collecting chamber 12 to the developing chamber 11 at the first communication port 16 and is delivered from the developing chamber 11 to the collecting chamber 12 at the second communication port 17. Thus, a developer circulation path is defined by the developing and collecting chambers 11 and 12, and the developer is mixed and agitated by circulating through the circulation path.

The developing chamber 11 is configured to supply the developer to the developing sleeve 3, and the collecting chamber 12 is configured to collect the developer stripped from the developing sleeve 3. That is, while being conveyed by the developing screw 13, the developer within the developing chamber 11 is attracted to the developing sleeve 3 at the position of the draw-up magnetic pole N1 of the magnet roller 4. Meanwhile, the guide member 151 provided at the upper part of the partition wall 15 extends from the upper end of the partition wall 15 to approach the developing sleeve 3 around the non-magnetic zone of the developing sleeve 3. Therefore, the developer stripped from the developing sleeve 3 at the stripping magnetic pole N3 is stored in the collecting chamber 12 without returning to the developing chamber 11. While collecting the developer, the collecting chamber 12 conveys the collected developer by the agitating screw 14.

The developing apparatus 1 of the present embodiment has the so-called function separated configuration in which the developing chamber 11 supplies the developer to the developing sleeve 3 and the collecting chamber 12 collects the developer from the developing sleeve 3. The developer on the developing sleeve 3 is collected across the longitudinal direction of the collecting chamber 12 in the function separated developing apparatus 1. Therefore, the developer is circulated through two paths of a first path through which the developer is conveyed from the developing chamber 11 to the collecting chamber 12 without passing through the developing sleeve 3 and a second path through which the developer is conveyed directly from the developing sleeve 3 to the collecting chamber 12. Accordingly, distribution of an amount the developer is apt to be non-uniform within the developing container 2, and a developer surface level is apt to be high downstream in the collecting chamber 12 because the developer is apt to accumulate downstream in the collecting chamber 12.

If fluidity of the developer drops, the delivery of the developer from the collecting chamber 12 to the developing chamber 11 is restrained as described above in the case of the prior-art developing apparatus. Then, the developer surface level increases within the collecting chamber 12, and the developer whose toner density is low is entrained by the developing sleeve 3. Due to that, such an image defect that density unevenness is apt to occur. In order to avoid such a case, it is essential to arrange such that the developer surface level does not become too high within the collecting chamber 12 even if fluidity of the developer drops.

Then, according to the present embodiment, the developer is raised at the first communication port 16 in conveying the developer before fluidity of the developer drops to accelerate the delivery of the developer from the collecting chamber 12 to the developing chamber 11. Even if the fluidity of the developer drops after that, the developer surface level hardly increases within the collecting chamber 12 to a degree of causing the entrainment of the developer by the developing sleeve 3 by accelerating the delivery of the developer. In view of the point described above, according to the present embodiment, a part of the agitating screw 14 is formed of a multi-threaded screw to raise the developer at the first communication port 16. This point will be detailed below with reference to FIGS. 3 and 4.

First Embodiment

Figure 4:
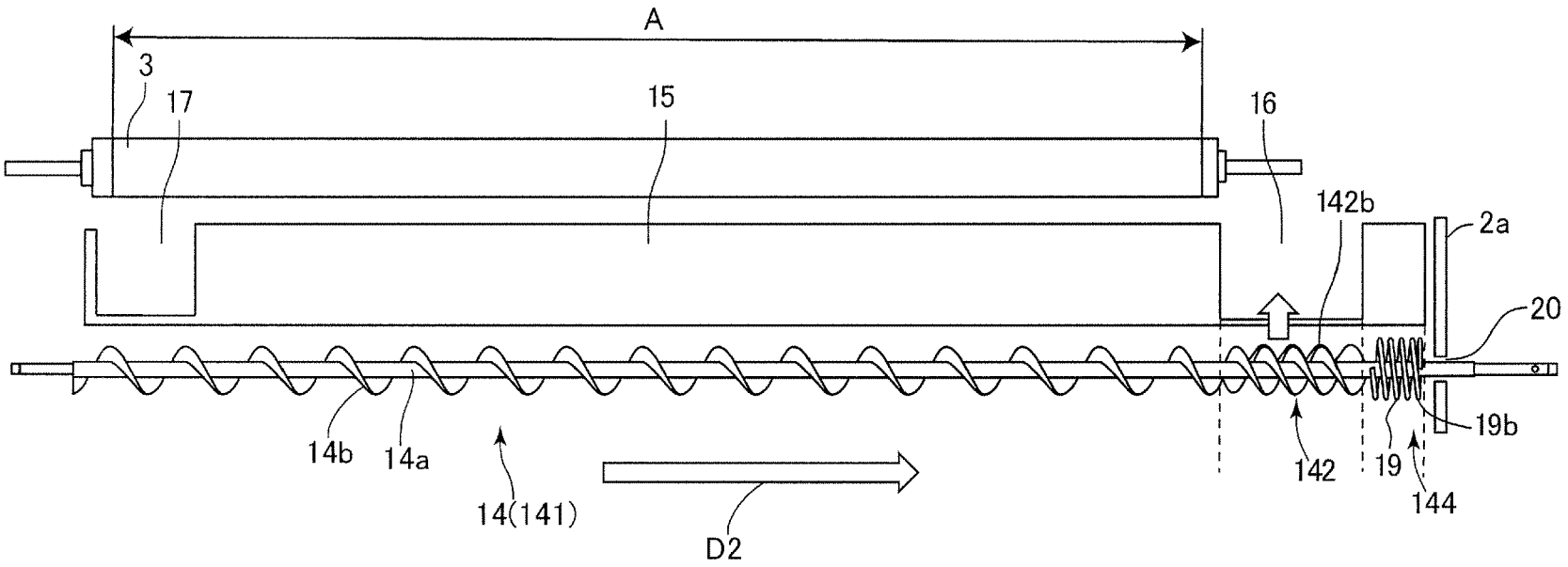
FIG. 4 illustrates an agitating screw of a first embodiment.

As illustrated in FIGS. 3 and 4, the agitating screw 14 includes a second conveyance portion 142 serving as a second screw portion downstream of the first conveyance portion 141 serving as the first screw portion. The second conveyance portion 142 is disposed at a position adjacent to and downstream of the first conveyance portion 141 and facing the first communication port 16 to convey the developer in the same direction with that of the first conveyance portion 141. The first conveyance portion 141 is a single-threaded screw composed of the rotary shaft 14*a* and a spiral blade 14*b* serving as a first blade formed around the rotary shaft 14*a*. Meanwhile, the second conveyance portion 142 is a multiple-threaded screw composed of the rotary shaft 14*a* and a spiral blade 142*b* serving as a second blade formed around the rotary shaft 14*a* and having a number of threads more than that of the first conveyance portion 141. Thus, in terms of the developer conveyance direction, the agitating screw 14 is formed such that a range thereof at least facing the developing area A is the single-threaded screw and a range thereof facing the first communication port 16 is the multiple-threaded (two here) screw. It is noted that the range of the agitating screw 14 facing the developing area A is made to be the single-threaded screw in order not to increase the developer surface level as much as possible. Accordingly, the first conveyance portion 141 is preferable to be the single-threaded screw. Thus, according to the present embodiment, the number of threads of the second conveyance portion is larger than that of the first conveyance portion. Here, a positional relationship of the respective portions will be described with reference to FIG. 4. A developing area A is an area in which the developer is coated on the developing sleeve 3. The first communication port 16 is disposed in an area out of the developing area A in the longitudinal direction, i.e., in a rotation axial direction, of the developing sleeve 3. This arrangement in which the developer surface level becomes high at the first communication port 16 is made to eliminate such a possibility that the developing sleeve 3 is coated again by the developer. While the first conveyance portion 141 is made to be the single-threaded screw across the entire area facing the developing area A in the present embodiment, it is also conceivable to arrange such that double-threaded screws are disposed at several places. This arrangement makes it also possible to obtain the same advantageous effect with the present embodiment because the developer surface level does not reach a level by which the developer is coated again. Therefore, if 90% or more of the area facing the developing area A is the single-threaded screw, practically a whole of that area may be considered as the single-threaded screw. The second conveyance portion 142 is disposed so as to face the first communication port 16. The second conveyance portion 142 is made to occupy at least 50% or more of a width of the first communication port 16 in the longitudinal direction of the developing sleeve 3. Although the second conveyance portion 142 may deviate out of the first communication port 16 of course, it is necessary to dispose the second conveyance portion 142 so as not face the developing area A.

It is possible to increase a ratio of a developer storage space occupied by the screw at the first communication port 16 as compared to a prior art configuration and to increase the developer surface level at the first communication port 16 if the developer amount is equal by disposing the multiple-threaded screw, i.e., the second conveyance portion 142, at the position facing the first communication port 16. This is because the developer surface level is influenced by a cross-sectional area orthogonal to the rotary shaft of the screw (referred to as a 'screw cross-sectional area' hereinafter). That is, because the larger the screw cross-sectional area, the greater the ratio of the screw occupying in the developer storage space is, the developer is raised and the developer surface level can be made high. Then, in order to increase the screw cross-sectional area, the multiple-threaded screw is used instead of the prior art single-threaded screw in the present embodiment. The use of the multiple-threaded screw makes it possible to readily increase the screw cross-sectional area.

Here, it is conceivable to thicken the diameter of the rotary shaft 14*a* of the agitating screw 14 if the screw cross-sectional area just needs to be increased. However, if the diameter of the rotary shaft 14*a* is thickened, an area of the blade 14*b* must be reduced instead of that because size of the screw which can be disposed within the collecting chamber 12 is limited. If the area of the blade 14*b* is reduced, the developer delivery amount from the collecting chamber 12 to the developing chamber 11 is liable to be reduced. If the developer delivery amount drops in the vicinity of the first communication port 16 in particular, the developer accumulates at an area where the diameter of the rotary shaft changes. As a result, the developer may be entrained by the developing sleeve 3. Accordingly, it is difficult to adopt the arrangement of thickening the diameter of the rotary shaft 14*a* of the agitating screw 14.

It is also conceivable to form a rib around the rotary shaft 14*a* of the agitating screw 14 to increase the screw cross-sectional area. However, because the rib is liable to scatter the developer, rather than delivering the developer from the collecting chamber 12 to the developing chamber 11, a developer delivery amount per one turn of the screw is apt to be reduced as compared to the spiral blade. The developer delivery amount is reduced in particular in the case of the configuration of the present embodiment in which the agitating screw 14 delivers the developer by rotating from upward to downward on the side of the partition wall 15, i.e., the first communication port 16. Accordingly, it is difficult to adopt the arrangement of forming the rib.

Therefore, in order to increase the screw cross-sectional area while increasing the developer delivery amount per one turn of the screw, the multiple-threaded screw is used in the present embodiment. In terms of the screw cross-sectional area, in the case of the single-threaded screw and the double-threaded screw whose screw pitch is 40 mm and a screw outer diameter is 18 mm for example, a cross-sectional area of the single-threaded screw is 1.2 $cm^2$ and a cross-sectional area of the double-threaded screw is 1.9 $cm^2$.

Figure 5:
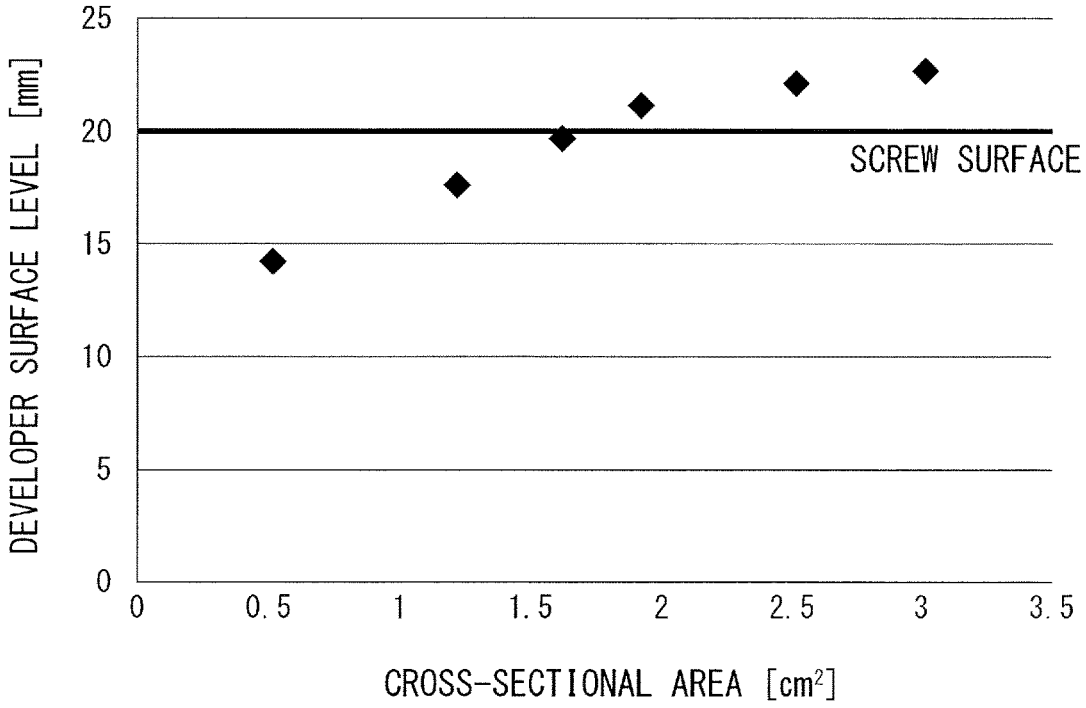
FIG. 5 is a graph representing a relationship between a screw cross-sectional area and a developer surface level at a communication port.

FIG. 5 is a graph representing results of the developer surface level at the first communication port 16 measured by changing the screw cross-sectional area. In FIG. 5, an axis of abscissa represents the screw cross-sectional area ($cm^2$) and an axis of ordinate represents the developer surface level (mm). FIG. 5 shows actually measured values in a case where 250 gram of developer is stored within the developing container 2.

As it is apparent from FIG. 5, the larger the screw cross-sectional area, the higher the developer surface level is. For instance, in a case where the screw cross-sectional area is 1.2 $cm^2$, the developer surface level is around 17 to 18 mm. In a case where the screw cross-sectional area is 1.9 $cm^2$, the developer surface level is around 20 to 22 mm. Then, when the screw cross-sectional area exceeds 1.8 $cm^2$, the developer surface level changes less. From this result, in the case when the double-threaded screw is used as the second conveyance portion 142, it is preferable to use a double-threaded screw whose screw cross-sectional area is 1.9 $cm^2$ by which the change of the developer surface level starts to be less.

Note that it is preferable to thin the diameter of the rotary shaft of the second conveyance portion 142 (multiple-threaded screw) than that of the rotary shaft of the first conveyance portion 141 (single-threaded screw). It is because the multiple-threaded screw can not only assure enough screw cross-sectional area for raising the developer but also readily increase the developer delivery amount by widening the area of the blade, i.e., accelerates the delivery of the developer, even if the diameter of the rotary shaft is small.

As described above, according to the developing apparatus 1 of the present embodiment, the agitating screw 14 at the first communication port 16 for delivering the developer from the collecting chamber 12 to the developing chamber 11 is formed to be the multiple-threaded screw, i.e., the second conveyance portion 142. It is possible to increase the developer surface level at the first communication port 16 by the increase of the screw cross-sectional area by using the multiple-threaded screw. However, if the developer surface level becomes high at the first communication port 16 and the developer surface level becomes high also within the collecting chamber 12 by being influenced by the developer surface level at the first communication port 16, an image defect caused by the entrainment of the developer of the developing sleeve 3 is apt to occur. Then, the multiple-threaded screw is used in the present embodiment to accelerate the delivery of the developer from the collecting chamber 12 to the developing chamber 11 at the first communication port 16 and to prevent the developer surface level from becoming so high that causes the entrainment of the developer of the developing sleeve 3. It is thus readily possible to raise the developer and to accelerate the delivery of the developer in conveying the developer by using the multiple-threaded screw, before fluidity of the developer drops. Accordingly, the image defect otherwise caused by the entrainment of the developer of the developing sleeve 3 hardly occurs due to the drop of the fluidity of the developer and the high developer surface level within the collecting chamber 12.

By the way, charge amount imparting ability, i.e., electrifying performance, of the carrier to the toner may drop along with the image forming operation in the developing apparatus 1 developing an image by using the two-component developer. If it happens, the toner charge amount drops, and such image defect that concentration fluctuation, toner scattering and image fogging may occur. Then, in order to restore the electrifying performance of the carrier, a control of refreshing the carrier (so-called ACR method) is made by replenishing developer from the replenishing unit 32 (see FIG. 1) connected with a replenishing port not illustrated and defined through the developing apparatus 1. In the ACR type developing apparatus, the extra developer caused by the replenishment of the developer overflows from the discharge port and is discharged out of the developing container 2. Thereby, the developer within the developing container 2 is kept at a constant amount even if the developer is replenished.

Discharge Port

Figure 6:
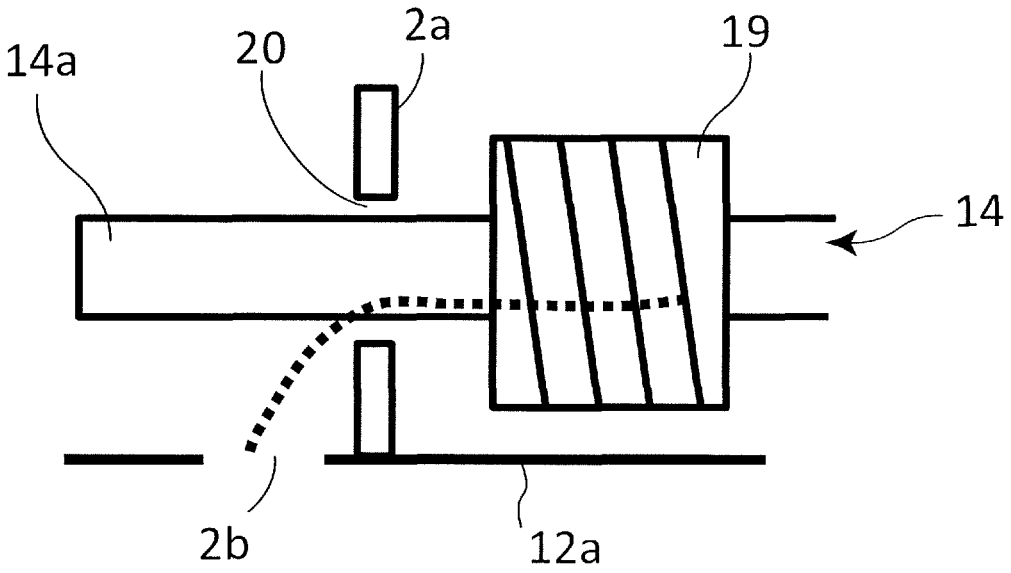
FIG. 6 is an enlarged schematic diagram of a discharge port and a return screw.

As illustrated in FIG. 4, the developing container 2 includes a wall 2*a* disposed at an end downstream of the collecting chamber 12, i.e., downstream in the second direction D2, in a direction intersecting with a developer conveyance direction and a discharge port 20 defined through the wall 2*a*. As illustrated in FIG. 6, the discharge port 20 is defined as a through hole through which a shaft portion of the rotary shaft 14*a* of the agitating screw 14, around which no blade is formed, penetrates and having a gap from an outer circumference of the rotary shaft 14*a* at the shaft portion. For instance, the rotary shaft 14*a* of the agitating screw 14 is formed to be 6 mm in diameter, and the discharge port 20 is defined to be 8 mm in diameter.

Here, it is conceivable to define the discharge port not through the wall 2*a* at the end of the developing container 2 but on a way of the conveyance path of the collecting chamber 12, i.e., at a predetermined height of a side wall surface facing the first conveyance portion 141. In this case, however, the developer may be discharged not only by the overflow from the discharge port 20 but also by being jumped up by the agitating screw 14. That is, as compared to the present embodiment in which the discharge port 20 is defined through the wall 2*a* at the end of the collecting chamber 12, the developer may be reduced too much in some case because the developer is liable to be discharged regardless of an amount of the developer stored in the collecting chamber 12. Then, an amount of the developer may not be assured upstream in the developer conveyance direction D1 of the developing screw 13 within the developing chamber 11 in particular, and the coating area of the developing sleeve 3 may be hardly equally coated. If the coating failure occurs, such image defect that image density is thinned or a white stripe is generated on the image may occur. In order to avoid such a case, it is preferable to define the discharge port 20 through the wall 2*a* of the end of the developing container 2, like the present embodiment, where the developer is hardly being jumped up.

Return Portion

As illustrated in FIG. 4, the agitating screw 14 includes a return portion 144 disposed upstream of the discharge port 20. The return portion 144 includes a return screw 19 composed of a return blade 19*b* wound around the rotary shaft 14*a* in a direction inverse to those of the blades 14*b* and 142*b* and conveying the developer in the first direction D1, i.e., in the direction opposite to that of the blades 14*b* and 142*b*. The return screw 19 is formed such that a screw pitch is 3 mm and a length in the developer conveyance direction, i.e., the longitudinal direction, of the agitating screw 14 is 20 mm.

In a case when a large amount of the developer reaches in front of the discharge port 20, and the developer surface level reaches a level of the gap between the rotary shaft 14*a*, i.e., a rotary shaft portion, and the discharge port 20, the developer is discharged out of the gap. That is, a large part of the developer conveyed by the first and second conveyance portions 141 and 142 toward the discharge port 20 is pushed back upstream, i.e., upstream in the second direction D2, by the return screw 19 and is delivered to the developing chamber 11 through the first communication port 16 without passing through the discharge port 20. Meanwhile, the developer not pushed back by the return screw 19 moves from the discharge port 20 to a downstream side of the collecting chamber 12 if the developer surface level becomes higher than the lower end of the discharge port 20. As illustrated in FIG. 6, the collecting chamber 12 is provided with a connection port 2*b* defined through the bottom surface portion 12*a*, and the developer is collected by a collecting container not illustrated and connected with the connection port 2*b*.

In the ACR type developing apparatus, an amount of the developer discharged out of the discharge port 20, i.e., a discharge amount, varies depending on the developer surface level. That is, the developer surface level in a vicinity of the discharge port 20 affects the discharge of the developer. For instance, if the developer surface level is always higher than the discharge port 20, the developer is excessively discharged. As a result, the developer within the developing container 2 decreases unnecessarily and is hardly supplied to the developing sleeve 3. Accordingly, it is necessary to restrain the developer surface level to an adequate level with respect to the discharge port 20 in the vicinity of the discharge port 20.

As described above, the use of the multiple-threaded screw makes it possible to accelerate the delivery of the developer in conveying the developer while making it possible to increase the developer surface level by increasing the ratio of the screw occupied in the developer storage space. At this time, the developer surface level is kept at an adequate level. However, in the case when the developer is replenished and an amount of the developer increases, there is a possibility that the developer is discharged unnecessarily if the developer raised by the multiple-threaded screw moves to the discharge port 20 as it is. That is, the discharge of the developer may become unstable by the raise of the developer. Then, it is necessary to adjust the surface level raised by the multiple-threaded screw to a level correctly reflecting the developer amount in front of the return screw 19 in order to stabilize the discharge of the developer. That is, because an amount of the developer sent to the discharge port 20 is adjusted by the return screw 19, it is preferable to return the developer surface level approximately to a same level before the developer surface level is raised by the multiple-threaded screw before reaching the return screw 19.

Second Embodiment

Figure 7:
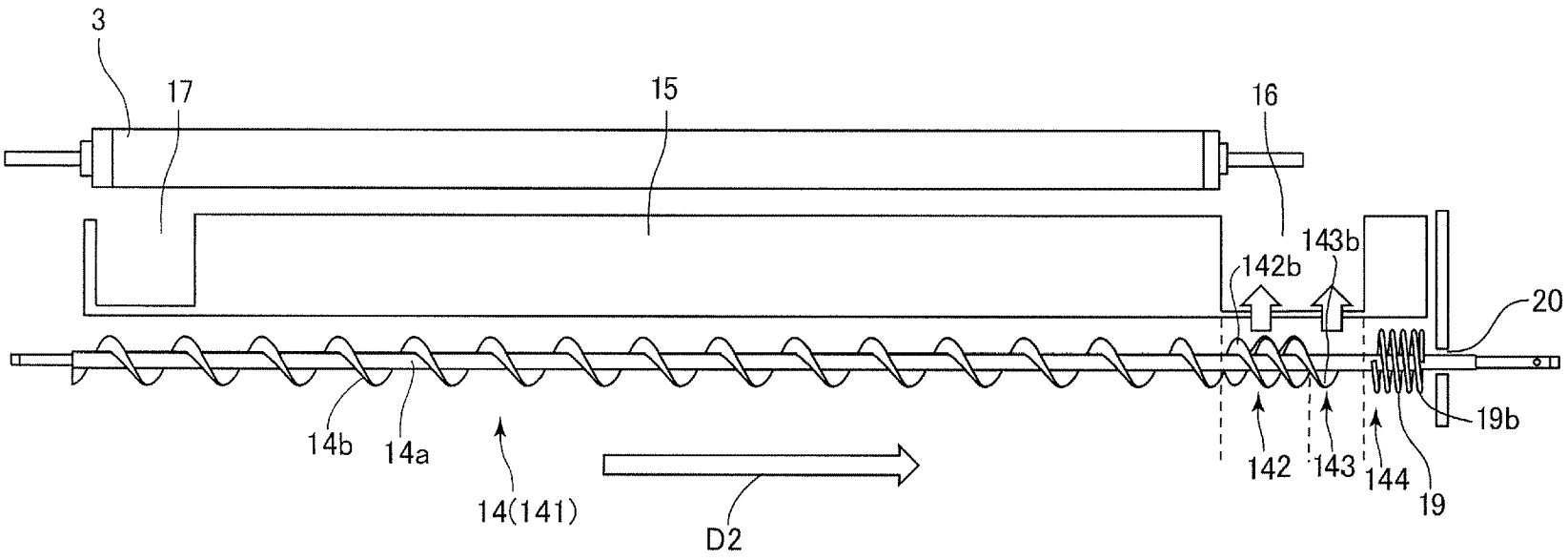
FIG. 7 is an upper schematic diagram illustrating an agitating screw of a second embodiment.

In view of the point described above, according to the present embodiment, the agitating screw 14 includes an intermediate portion 143 whose screw cross-sectional area is reduced to be less than that of the second conveyance portion 142 between the second conveyance portion 142 and the return portion 144 as illustrated in FIG. 7. The intermediate portion 143 is disposed at a position facing the first communication port 16 and downstream adjacently of the second conveyance portion 142. The intermediate portion 143 is a single-threaded screw having 40 mm of screw pitch for example and including the rotary shaft 14*a* and a spiral blade 143*b* formed around the rotary shaft 14*a* and serving as a third blade whose number of threads is less than that of the second conveyance portion 142.

Because the screw cross-sectional area of the intermediate portion 143 is smaller than that of the second conveyance portion 142, the developer is hardly raised by the intermediate portion 143 as compared to the second conveyance portion 142 in the case of the present embodiment. Therefore, the developer surface level raised by the second conveyance portion 142 drops at the intermediate portion 143.

In terms of length in the developer conveyance direction of the agitating screw 14, if the first communication port 16 is 40 mm in length, the second conveyance portion 142 and the intermediate portion 143 are defined to be 20 mm in length. The present embodiment is not limited to those lengths of course. For instance, the length in the developer conveyance direction of the agitating screw 14 in the second conveyance portion 142 is desirable to be a width that permits to assure the blade 142*b* to turn one time within the first communication port 16. Thereby, an amount of the developer of one round in a screw circumferential direction is conveyed within the first communication port 16. Because the double-threaded screw is used here as the second conveyance portion 142, desirably the second conveyance portion 142 is formed to have a length of 20 mm or more.

It is noted that while the single-threaded screw is used for the intermediate portion 143 in the present embodiment, the screw cross-sectional area of the intermediate portion 143 may be smaller than that of the second conveyance portion 142 because the developer surface level raised by the second conveyance portion 142 just needs to be lowered in the intermediate portion 143. That is, the number of threads of the intermediate portion 143 just needs to be less than that of the second conveyance portion 142 and is not limited to be the single-threaded screw. For instance, the intermediate portion 143 may be the shaft portion of the rotary shaft 14*a* around which no third blade 143*b* is formed.

As described above, the developing apparatus 1 of the present embodiment is arranged to be able to adjust the developer surface level raised by the second conveyance portion 142 to the adequate surface level by the intermediate portion 143. This arrangement makes it possible to adequately discharge the developer out of the discharge port 20 because the developer raised by the second conveyance portion 142 does not reach the return portion 144 as it is. That is, the developer is discharged out of the discharge port 20 normally.

Other Embodiments

It is noted that while the double-threaded screw has been used as the second conveyance portion 142 in the embodiment described above, the present disclosure is not limited to such configuration. The second conveyance portion 142 may be a triple-threaded or a quadruple-threaded screw whose number of threads is greater than that of the embodiment described above. In short, the second conveyance portion 142 may be a screw whose number of threads is greater than that of the first conveyance portion 141. Still further, the agitating screw 14 is not limited to what is integrally formed. For instance, the agitating screw 14 may be what the respective independent screws of the first conveyance portion 141, the second conveyance portion 142, the intermediate portion 143 and the return portion 144 are connected with each other.

It is noted that while the embodiments described above have been described based on the image forming apparatus 100 of the intermediate transfer type in which the toner images of the respective colors are primarily transferred from the photosensitive drums 10 of the respective colors onto the intermediate transfer belt 25 and then the composite toner images of the respective colors are collectively and secondarily transferred onto the recording material S, the present disclosure is not limited to such configuration. For instance, the image forming apparatus may be a direct transfer type in which toner images are directly transferred from the photosensitive drums onto a recording material carried and conveyed by a transfer material conveyance belt.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-086444, filed on Apr. 22, 2016, which is hereby incorporated by reference herein in its entirety.

What is claimed is:

1. A developing apparatus, comprising:

a rotatable developer bearing member configured to bear developer including toner and carrier, and to convey the developer to a developing area facing an image bearing member;

a first chamber disposed below a rotation axis of the developer bearing member and configured to supply the developer to the developer bearing member in a state in which the developing apparatus is set to a developing position where the developing apparatus develops an electrostatic latent image born on the image bearing member;

a second chamber disposed to face the developer bearing member and to which the developer passing the developing area is collected from the image bearing member in the state in which the developing apparatus is set to the developing position;

a first communication portion which permits communication of the developer in the first chamber to the second chamber;

a second communication portion which permits communication of the developer in the second chamber to the first chamber;

a first conveyance screw disposed in the first chamber and configured to convey the developer in a first direction from the second communication portion toward the first communication portion;

a second conveyance screw disposed in the second chamber and configured to convey the developer in a second direction from the first communication portion toward the second communication portion, the second conveyance screw comprising:

a first screw portion disposed to face the second communication portion;

a second screw portion disposed downstream of the first screw portion in the second direction; and a third screw portion disposed downstream of the first screw portion and upstream of the second screw portion in the second direction and facing the second communication portion;

a magnet fixedly disposed within the developer bearing member and configured to generate a magnetic field to strip the developer passing the developing area from a surface of the developer bearing member, the magnet comprising:

a first pole; and a second pole having the same polarity as the first pole and disposed adjacent to the first pole on a downstream side of a peak position where magnetic flux density of the first pole becomes a maximum in a rotation direction of the developer bearing member;

a partition wall configured to separate the first chamber from the second chamber and comprising a guiding portion, the guiding portion being configured to guide and collect the developer passing the developing area from the developer bearing member to the second chamber, the guiding portion being disposed to face the developer bearing member such that a closest position, where the guiding portion is closest to the developer bearing member, is downstream of the peak position of magnetic flux density of the first pole and upstream of a peak position of magnetic flux density of the second pole;

a developer replenishing portion configured to replenish the developer; and a developer discharge portion disposed downstream of the second conveyance screw in the second direction and configured to discharge a part of the developer according to replenishment of the developer from the developer replenishing portion, wherein a bottom of the second chamber is above a bottom of the first chamber in a state where the developing apparatus is set to the developing position, the first screw portion comprises a first blade portion formed spirally around a rotation shaft of the second conveyance screw and configured to convey the developer in the second chamber in the second direction, the second screw portion comprises a second blade portion formed spirally around the rotation shaft of the second conveyance screw, the second blade portion being configured to convey the developer in the second chamber in the first direction and deliver the developer in the second chamber to the second communication portion, and the third screw portion comprises no blade portion formed spirally around the rotation shaft of the second conveyance screw.

2. The developing apparatus according to claim 1, wherein the first blade portion has a plurality of threads.

3. The developing apparatus according to claim 1, wherein the second conveyance screw comprises a fourth screw portion disposed upstream of the first screw portion in the second direction, the fourth screw portion comprising a forth blade portion formed spirally around the rotation shaft of the second conveyance screw and configured to convey the developer in the second chamber in the second direction, and the number of threads of the first blade portion is larger than that of the fourth blade portion.

4. The developing apparatus according to claim 3, wherein the number of threads of the fourth screw portion in an area facing an area of the developer bearing member corresponding to a maximum image formation area among an image formation area which is capable of forming an image on the image bearing member is one.

5. The developing apparatus according to claim 1, wherein the second communication portion is disposed downstream, in the second direction, of an area of the developer bearing member corresponding to a maximum image formation area among an image formation area which is capable of forming an image on the image bearing member.

* * * * *